US007747179B2

(12) United States Patent
Ahn

(10) Patent No.: US 7,747,179 B2
(45) Date of Patent: Jun. 29, 2010

(54) IMAGE FORMING APPARATUS AND STORAGE THEREOF

(75) Inventor: Byung-sun Ahn, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/151,538

(22) Filed: Jun. 14, 2005

(65) Prior Publication Data

US 2006/0045549 A1 Mar. 2, 2006

(30) Foreign Application Priority Data

Sep. 2, 2004 (KR) ..... 10-2004-0070000

(51) Int. Cl.
*G03G 15/00* (2006.01)

(52) U.S. Cl. ..... 399/25; 399/26

(58) Field of Classification Search ..... 399/25, 399/26

See application file for complete search history.

(56) References Cited

U.S. PATENT DOCUMENTS

| | | | | |
|---|---|---|---|---|
| 5,017,962 | A * | 5/1991 | Tsuji et al. | 399/120 |
| 6,351,621 | B1 * | 2/2002 | Richards et al. | 399/111 |
| 6,625,403 | B2 * | 9/2003 | Carling et al. | 399/24 |
| 2004/0156657 | A1 * | 8/2004 | Takeuchi et al. | 399/302 |

FOREIGN PATENT DOCUMENTS

| | | | |
|---|---|---|---|
| JP | 06067484 | * | 3/1994 |
| JP | 06-250481 | | 9/1994 |
| JP | 11-327252 | | 11/1999 |
| JP | 2001-066845 | | 3/2001 |
| JP | 2003-295574 | | 10/2003 |
| JP | 2004-004990 | | 1/2004 |
| JP | 2004-009435 | | 1/2004 |
| JP | 2004-045862 | | 2/2004 |
| JP | 2004-093817 | | 3/2004 |
| KR | 100366646 | B1 | 12/2002 |

* cited by examiner

*Primary Examiner*—David M Gray
*Assistant Examiner*—Joseph S Wong
(74) *Attorney, Agent, or Firm*—Roylance, Abrams, Berdo & Goodman, LLP

(57) ABSTRACT

An image forming apparatus manages information regarding the lifetimes of a plurality of photosensitive media or developing units using a single storage. The image forming apparatus includes a photosensitive unit comprising a photosensitive medium, a developing unit comprising a developing roller that applies developer to the photosensitive medium and a developing device that is removable and contains the developer supplied to the developing roller. A storage is included in one of the photosensitive unit or the developing unit, whichever has a longer lifetime, and stores information regarding at least one of the photosensitive unit and the developing unit. A controller controls the information stored in the storage. The image forming apparatus has a plurality of photosensitive units and/or developing units.

8 Claims, 7 Drawing Sheets

IMAGE FORMING APPARATUS AND STORAGE THEREOF

CROSS-REFERENCE TO RELATED APPLICATION

This application claims the benefit under 35 U.S.C. §119 (a) of Korean Patent Application No. 10-2004-0070000, filed on Sep. 2, 2004, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus that includes a single storage to manage the lifetimes of components (such as developing units and photosensitive media) included in an integrated developing unit in the image forming apparatus.

2. Description of the Related Art

FIG. 1 illustrates the structure of a conventional image forming apparatus including a storage in each of a plurality of developing units. Referring to FIG. 1, a conventional electrophotographic color image forming apparatus 100 includes a developing unit 110, photosensitive media 145Y, 145M, 145C, and 145K, an optical scanning unit 150, an intermediate transfer belt 155, first transfer rollers 157Y, 157M, 157C, and 157K, a second transfer roller 160, and a fusing unit 165 within a case 101. In addition, the conventional electrophotographic color image forming apparatus 100 includes a paper feed cassette 105 containing paper P, a pickup roller 167 picking up paper P from the paper feed cassette 105, a paper feed roller 169 aligning and feeding paper P, first and second feed rollers 172 and 174 feeding paper P that has an image fused onto it, and a discharge roller 176 discharging the printed paper P from the case 101 onto a discharge tray 103.

The developing unit 110 includes four developing devices 112Y, 112M, 112C, and 112K. The developing devices are cartridge type devices which are replaced with new ones when developer, or toner, is depleted. Sequentially from the bottom of the case 101, the four developing devices 112Y, 112M, 112C, and 112K contain yellow (Y), magenta (M), cyan (C) and black (K) toners, respectively.

The developing devices 112Y, 112M, 112C, and 112K of the developing unit 110 include developing rollers 113Y, 113M, 113C, and 113K, respectively, to supply toner to the four photosensitive media 145Y, 145M, 145C, and 145K, respectively, which are installed within the case 101 separate from the developing devices 112Y, 112M, 112C, and 112K. To supply toner to the photosensitive media 145Y, 145M, 145C, and 145K, developing bias is applied to the developing rollers 113Y, 113M, 113C, and 113K. The outer circumferences of the respective photosensitive media 145Y, 145M, 145C, and 145K face the intermediate transfer belt 155.

The optical scanning unit 150 includes four optical scanners 151Y, 151M, 151C, and 151K corresponding to the photosensitive media 145Y, 145M, 145C, and 145K, respectively. The optical scanners 151Y, 151M, 151C, and 151K scan light beams corresponding to Y, M, C, and K color image information onto the photosensitive media 145Y, 145M, 145C, and 145K, respectively. Laser scanning units (LSUs) using a laser diode as a light source may be used as the optical scanners 151Y, 151M, 151C, and 151K.

The first transfer rollers 157Y, 157M, 157C, and 157K are positioned to face the photosensitive media 145Y, 145M, 145C, and 145K, respectively, with the intermediate transfer belt 155 interposed therebetween. The second transfer roller 160 is positioned to face the intermediate transfer belt 155.

As shown in FIG. 1, integrated structures A, B, C, and D are implemented for colors K, C, M, and Y, respectively. The integrated structures A, B, C, and D include-storages 130K, 130C, 130M, and 130Y, respectively. Alternatively, although not shown, the photosensitive media 145Y, 145M, 145C, and 145K and the developing devices 112Y, 112M, 112C, and 112K may be implemented in 8 separate structures including 8 storages. Each of the storages 130K, 130C, 130M, and 130Y may be a customer replaceable unit monitor (CRUM) and store information such as the manufacturing date, the serial number, the manufacturing company, the lifetime, and the amount of residual toner in the developing unit 110. The information is provided to a user at a predetermined time.

Such conventional image forming apparatuses have problems. For example, since a storage is installed in each of a plurality of developing devices, the price of the image forming apparatus increases. In addition, since a plurality of storages are installed, the probability of malfunction is high, and, therefore, reliability and processing speed are low, as a whole.

Accordingly, there is a need for an image forming apparatus with an improved storage to increase the reliability and processing speed of the apparatus.

SUMMARY OF THE INVENTION

An aspect of the present invention is to solve at least the above problems and/or disadvantages and to provide at least the advantages described below. Accordingly, an aspect of the present invention is to provide an image forming apparatus with a structure in which at least two developing units are integrated and information is managed using a single storage, thereby decreasing manufacturing costs and increasing reliability.

According to an aspect of the present invention, an image forming apparatus includes a single storage to manage information regarding a plurality of photosensitive media and/or developing units.

According to another aspect of the present invention, an image forming apparatus includes a photosensitive unit comprising a photosensitive medium, a developing unit comprising a developing roller that applies developer to the photosensitive medium, and a developing device that is removable and contains the developer supplied to the developing roller. A storage is included in one of the photosensitive unit and the developing unit, whichever has a longer lifetime. The storage stores information regarding at least one of the photosensitive unit and the developing unit. A controller controls the information stored in the storage. The image forming apparatus contains a plurality of photosensitive units and/or developing units.

The image forming apparatus may further include a plurality of integrated developing units which are replaceable individually and each of which includes at least two developing units. The storage may be included in each of the plurality of integrated developing units.

Alternatively, the image forming apparatus may further include a plurality of integrated developing units comprising an integrated photosensitive unit and corresponding developing unit. The storage may be included in each of the plurality of integrated developing units.

The controller may identify an integrated developing unit when the image forming apparatus is booted or when the integrated developing unit is loaded into the image forming apparatus, read and update predefined information in the storage when a printing job is terminated, calculate and update the amount of developer remaining in the developing device, count the number of developing device replacements, and report the need to replace an integrated developing unit including the developing device when the counted number of replacements reaches a predetermined threshold value.

The storage may be included in the photosensitive unit, and the information stored in the storage may relate to the lifetime of at least one of the photosensitive unit and the developing unit.

According to still another aspect of the present invention, an image forming apparatus includes a first photosensitive unit comprising a first photosensitive medium and a second photosensitive unit comprising a second photosensitive medium. A plurality of developing units are provided, and each developing unit comprises a developing roller applying developer to one of the first photosensitive medium or the second photosensitive medium and a removable developing device containing developer supplied to the developing roller. A first storage stores predefined information regarding the first photosensitive medium and a developing unit corresponding to the first photosensitive medium. A second storage stores predefined information regarding the second photosensitive medium and a developing unit corresponding to the second photosensitive medium. A controller controls the information stored in the storages. The plurality of developing units includes four developing units containing cyan, magenta, yellow and black developers.

A portion of the four developing units may be integrated with the first photosensitive medium into a first integrated developing unit, while the remaining developing units may be integrated with the second photosensitive medium into a second integrated developing unit.

The first storage may store predefined information regarding the lifetimes of the first photosensitive medium and the developing units corresponding to the first photosensitive medium in the first integrated developing unit. The second storage may store predefined information regarding the lifetimes of the second photosensitive medium and the developing units corresponding to the second photosensitive medium in the second integrated developing unit.

The first storage may be included in the first photosensitive unit and may store predefined information regarding the lifetimes of the first photosensitive medium and developing units corresponding to the first photosensitive medium. The second storage may be included in the second photosensitive unit and may store predefined information regarding lifetimes of the second photosensitive medium and developing units corresponding to the second photosensitive medium.

According to yet another aspect of the present invention, there is provided a storage of an image forming apparatus including a plurality of photosensitive media and a plurality of developing units each applying developer to an electrostatic latent image formed on a surface of one of the photosensitive media, the storage storing predefined information regarding at least part of the plurality of photosensitive media and the plurality of developing units.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENT

Figure 1:
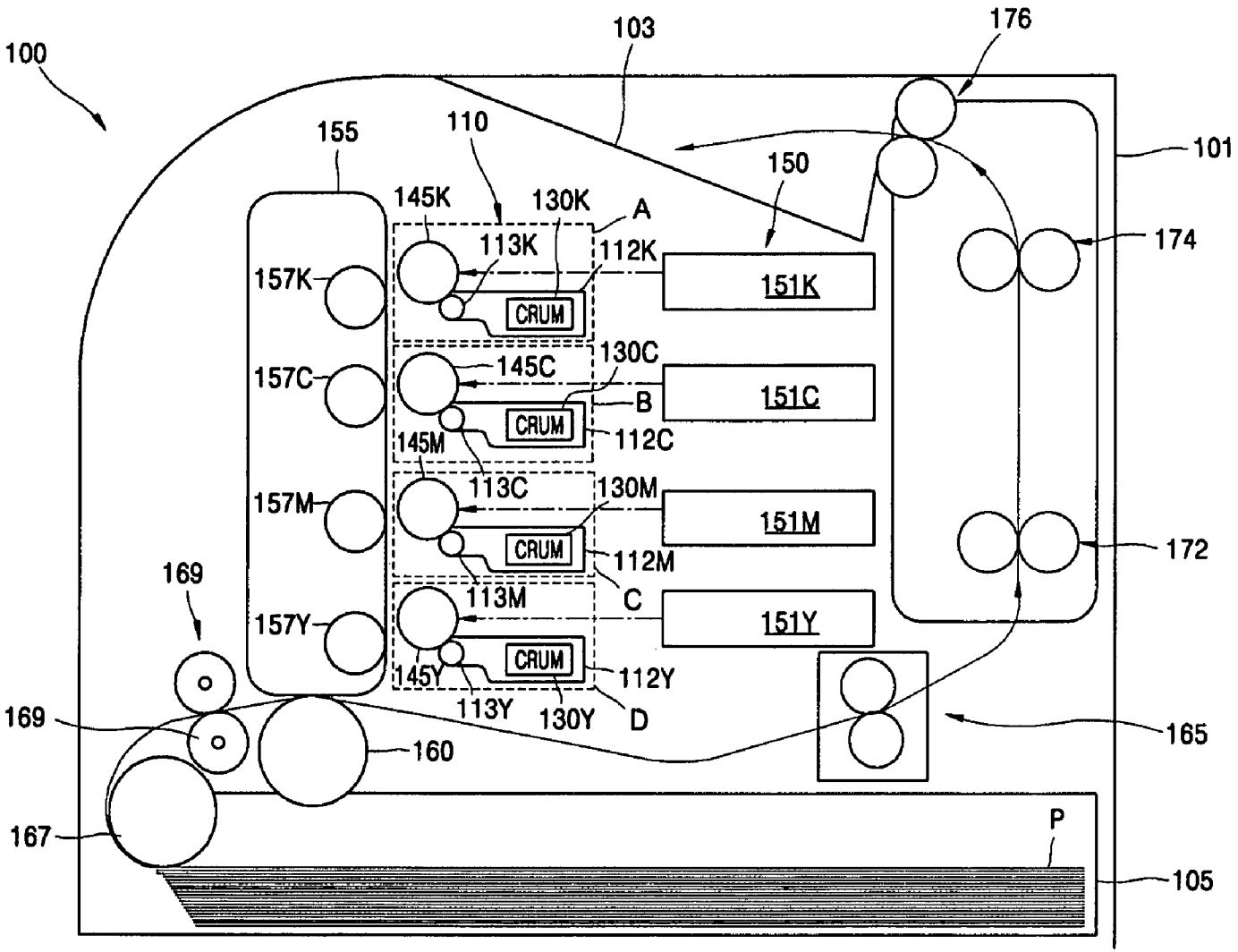
FIG. 1(PRIOR ART)
FIG. 1 is a diagram of a conventional image forming apparatus that includes a storage in each developing device.
Figure 2:
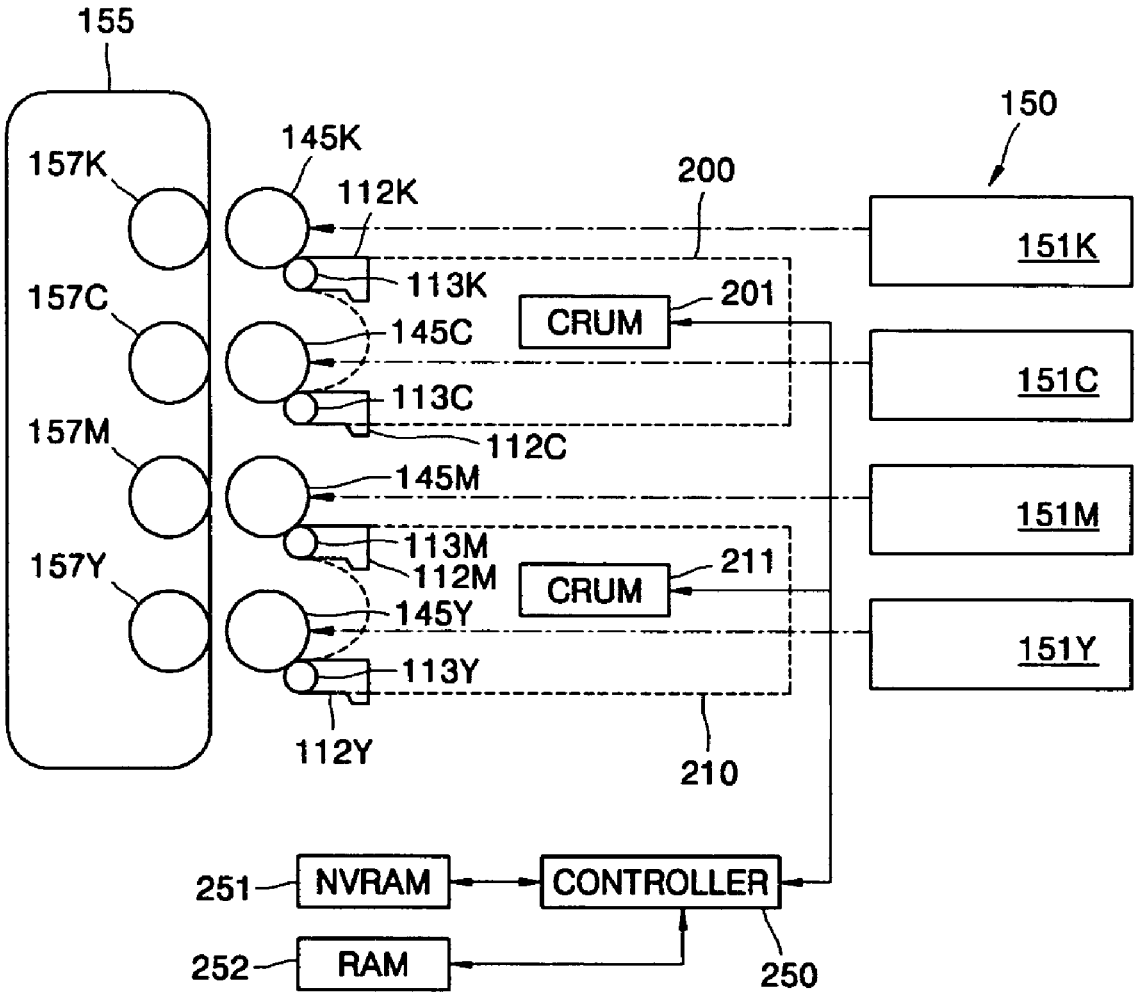
FIG. 2 is a partial diagram of a single-pass image forming apparatus that has a structure in which a plurality of developing units are integrated by a single frame and in which a developing unit is separated from a photosensitive medium, according to an embodiment of the present invention.

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

As used herein, the term "developing unit" is used to refer to the assembly of a cartridge-type developing device and a developing roller, and the term "integrated developing unit" is used to refer to an assembly of a cartridge-type developing device, a developing roller, and a photosensitive medium. Information (such as the lifetime) regarding an integrated developing unit is managed using a single storage, in some embodiments of the present invention. The integrated developing unit is connected to a single frame so that it can be replaced as a unit. The cartridge-type developing device included in the integrated developing unit can also be replaced separately. Characters Y, M, C, and K denote yellow, magenta, cyan, and black, respectively.

FIGS. 2 through 4B illustrate image forming apparatuses according to embodiments of the present invention. In the embodiment illustrated in FIG. 2, an image forming apparatus has a plurality of developing units that are integrated by a single frame. Images are formed using a single-pass method, and each developing unit is separate from each photosensitive medium. Two integrated developing units 200 and 210 are arranged vertically. The integrated developing unit 200 includes cartridge-type developing devices 112K and 112C. The integrated developing unit 210 includes cartridge-type developing devices 112M and 112Y. The two integrated developing units 200 and 210 also include storages, i.e., customer replaceable unit modules (CRUMs) 201 and 211, respectively. To manage the useful life of expendable components (for example, the developing units or the photosensitive media), the image forming apparatus according to an embodiment of the present invention includes a controller 250, non-volatile random access memory (NVRAM) 251, and random access memory (RAM) 252. The NVRAM 251 stores a unique serial number (S/N), the identity of the provider (or manufacturer) of each integrated developing unit, the resolution (or dots per inch (dpi)), the motor operating time, the amount of residual toner, and the number of times the developing device has been replaced, which are read from a storage of the integrated developing unit, and any other pertinent information. The RAM 252 stores various application programs for operating the image forming device.

The CRUM 201 in the integrated developing unit 200 manages the lifetimes of the photosensitive media 145K and 145C and the cartridge-type developing devices 112K and 112C that include, respectively, developing rollers 113K and 113C. The cartridge-type developing devices 112K and 112C are designed to be removed from the integrated developing unit 200 since the lifetime of the photosensitive medium is usually longer than that of the developing device. With this design, after the developing devices 112K and 112C are replaced a predetermined number of times (which can be determined through experiments or experience), the photosensitive media 145K and 145C and the developing devices 112K and 112C included in the integrated developing unit 200 may all be replaced at one time.

The CRUM 201 stores predetermined information, including a unique S/N of the integrated developing unit 200, the dpi, the motor operating time, the amount of residual toner, and the number of developing device replacements.

When the integrated developing unit 200 is replaced with an old one or when the image forming apparatus is booted, it is verified whether the S/N stored in the CRUM 201 is identical with the S/N registered in the NVRAM 251 to authenticate the integrated developing unit 200. If a new integrated developing unit whose S/N is not registered in the NVRAM 251 is connected to the image forming apparatus, the S/N of the new integrated developing unit is registered in the NVRAM 251.

The dpi and the motor operating time are used to calculate the amount of toner consumed by printing. The motor operating time indicates the period of time that the motor operates to rotate each of the photosensitive media 145K and 145C. In the exemplary embodiments of the present invention described here, the motor operating time and the dpi are used to obtain the amount of consumed toner. However, the amount of consumed toner can be obtained using any method known to one skilled in the art, including experimental numerical values. Since these methods are known, a detailed description of the method of obtaining the amount of consumed toner is omitted for clarity and conciseness.

The amount of residual toner indicates the amount of toner remaining in each of the developing devices 112K and 112C and can be updated by subtracting the amount of consumed toner calculated using the dpi and the motor operating time after printing from the amount of toner stored before printing.

In addition, the CRUM 201 may include information such as the manufacturing date of the integrated developing unit 200, the number of developing device replacements, a threshold value of the number of developing device replacements, and/or a threshold value of the amount of residual toner. When the number of replacements of any one of the developing devices 112K and 112C reaches the threshold value of the number of developing device replacements (that is, the lifetime of the photosensitive medium 145K or 145C contacting the developing device 112K or 112C reaches a limit), the integrated developing unit 200 including the developing device 112K or 112C and the photosensitive medium 145K or 145C is replaced as a whole.

The numbers of replacements of the respective developing devices 112K and 112C are used to control replacement of the photosensitive media 145K and 145C. For example, when the photosensitive media 145K and 145C has a lifetime of 12,000 pages at 5% density and full toner corresponds to 2,000 pages, the controller 250 may determine that the lifetime of the photosensitive medium 145K or 145C has expired when the developing device 112K or 112C contacting the photosensitive medium 145K or 145C has been replaced 6 times.

Figure 3:
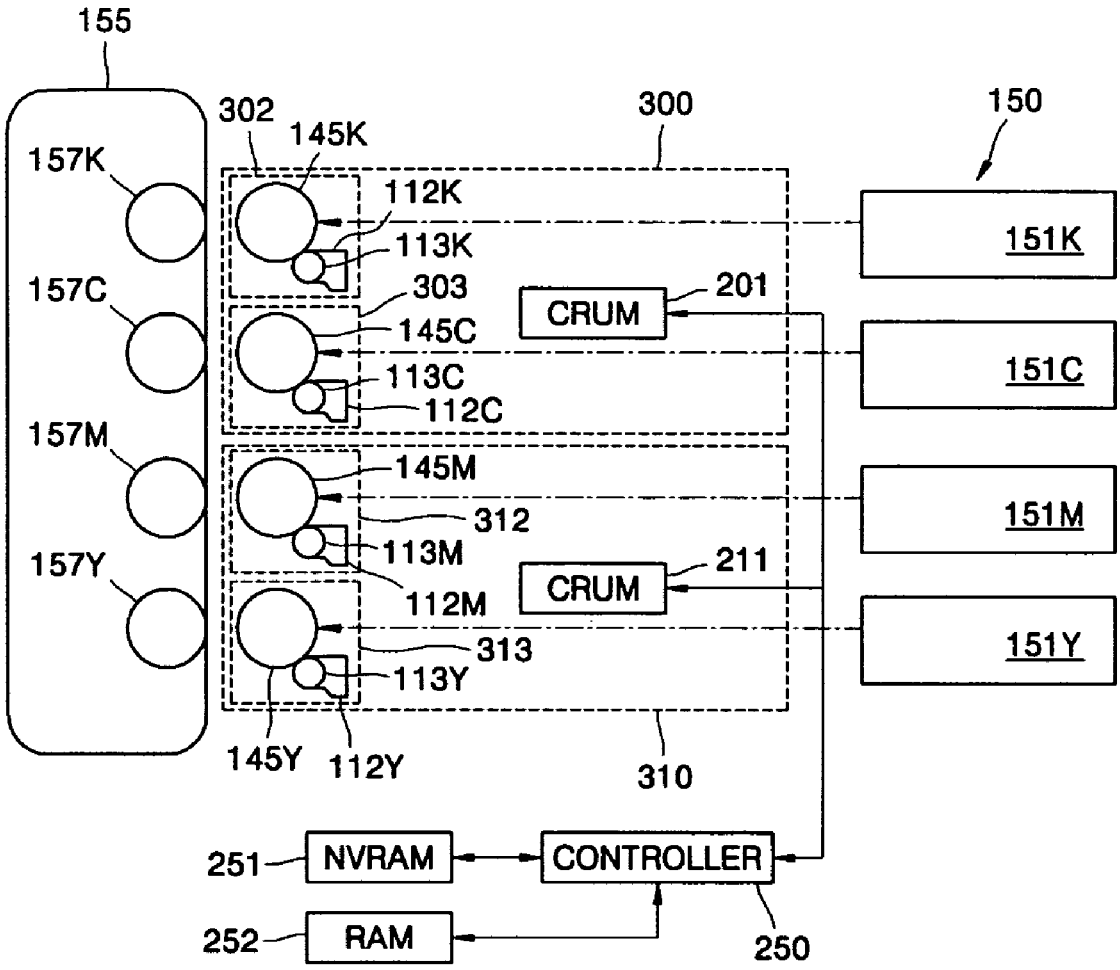
FIG. 3 is a partial diagram of a single-pass image forming apparatus in which a developing unit and a photosensitive medium are integrated by a frame, according to an embodiment of the present invention.

FIG. 3 is a diagram of a part of a single-pass method image forming apparatus in which a developing device and a photosensitive medium are integrated by a frame to form a developing unit, according to an embodiment of the present invention. Referring to FIG. 3, the developing unit which comprises the developing device 112K (which includes the developing roller 113K and developer) and the corresponding photosensitive medium 145K is integrated into a structure 302. Similarly, the developing units including the respective developing devices 112C, 112M, and 112Y and their corresponding photosensitive media 1450, 145M, and 145Y are integrated into structures 303, 312, and 313, respectively. The structures 302 and 303 are integrated by a frame into an integrated developing unit 300 so that they can be replaced together. An integrated developing unit 310 is formed in the same manner.

Figure 4A:
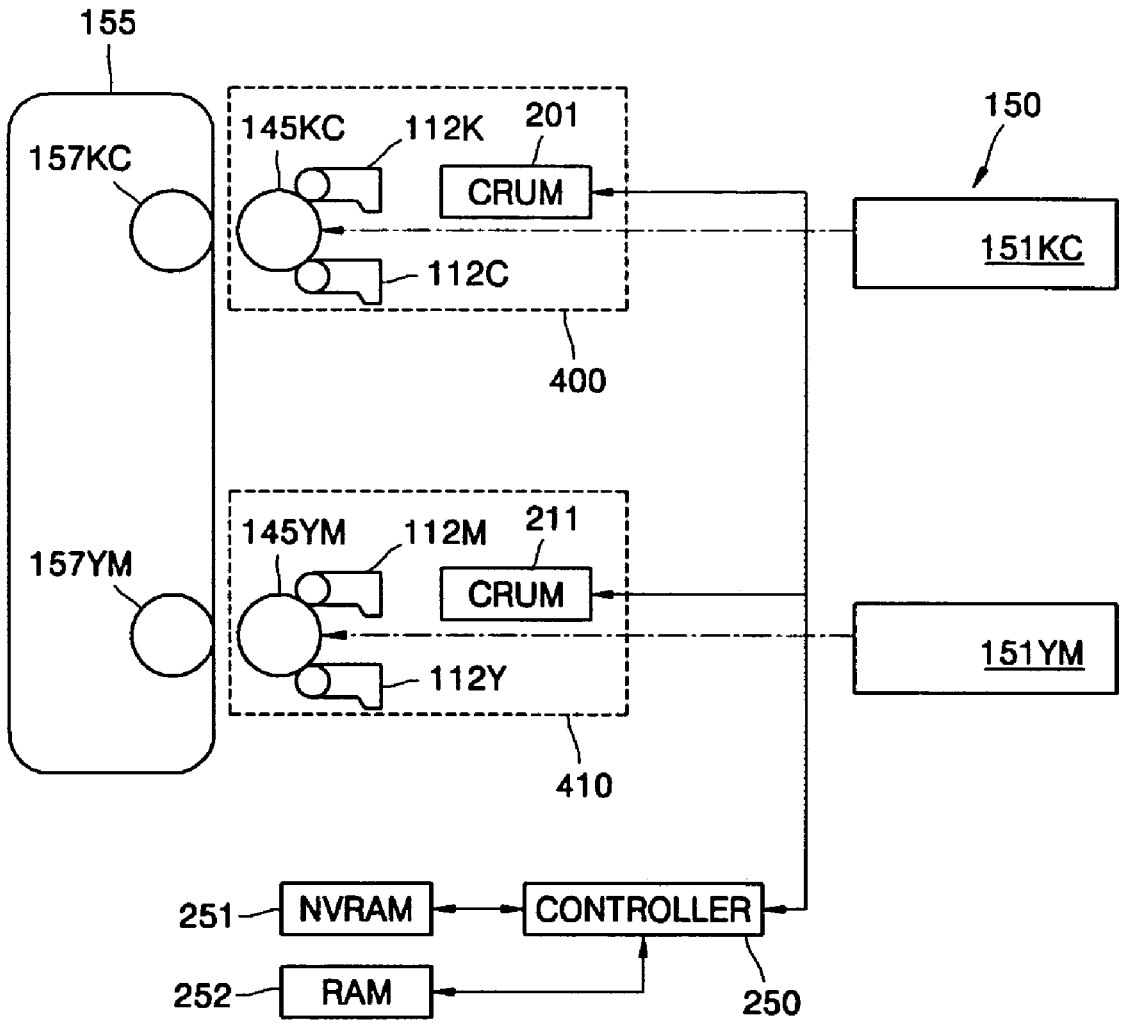
FIG. 4A is a partial diagram of a two-pass image forming apparatus in which developing units and a photosensitive medium are integrated by a frame, according to an embodiment of the present invention.
Figure 4B:
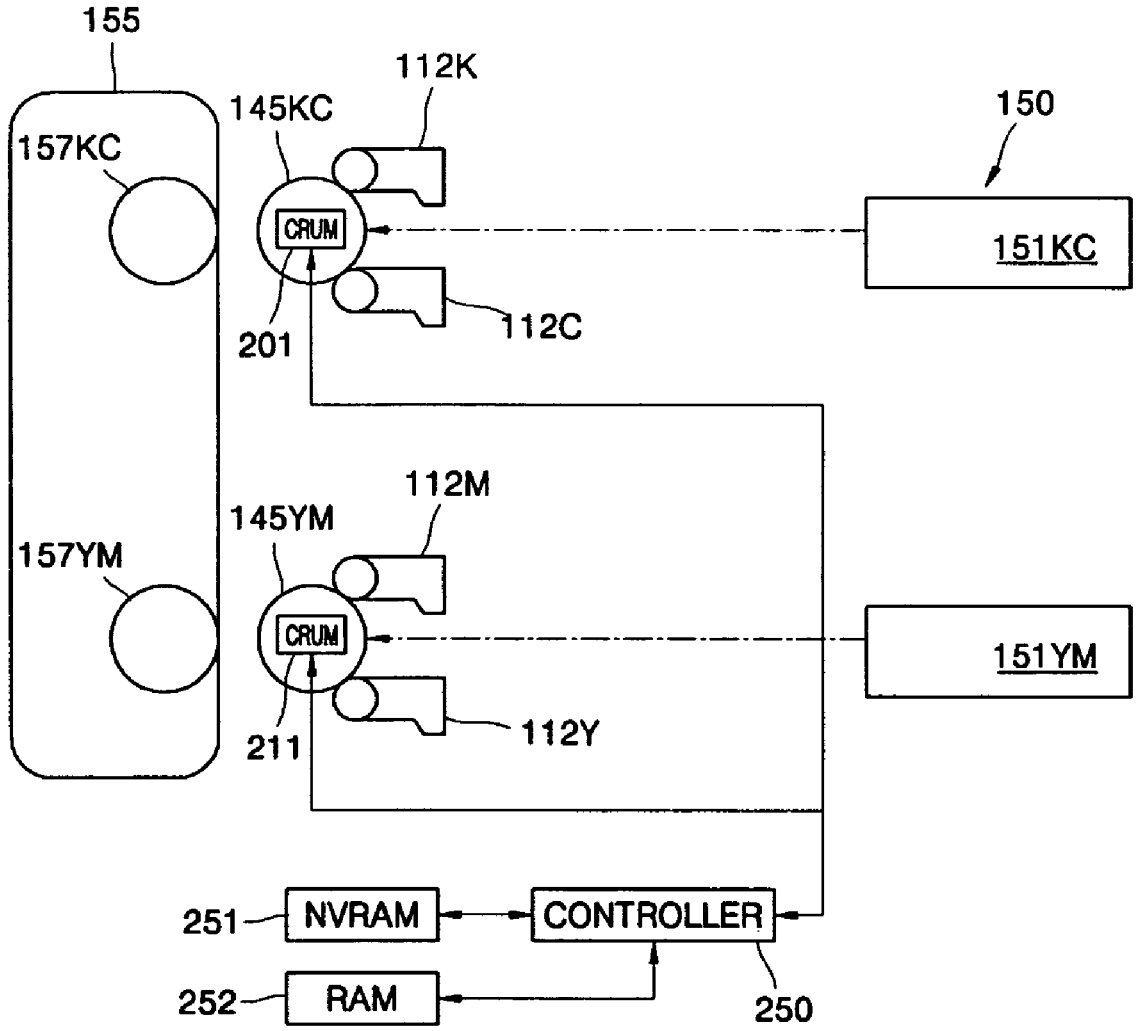
FIG. 4B is a partial diagram of a two-pass image forming apparatus in which developing units are connected to a photosensitive medium, according to an embodiment of the present invention.

FIGS. 4A and 4B are diagrams of a part of a two-pass method image forming apparatus in which two developing units are connected to a single photosensitive medium, according to further embodiments of the present invention. Referring to FIG. 4A, with respect to K and C colors, a single photosensitive medium 145KC and the two developing units respectively including the developing devices 112K and 112C are integrated into an integrated developing unit 400, which includes the CRUM 201 to manage the lifetimes of the elements 145KC, 112K, and 112C. An integrated developing unit 410 is formed in the same manner with respect to Y and M colors.

In contrast to the embodiment illustrated in FIG. 4A, the elements (such as the photosensitive medium 145KC and the developing units respectively including the developing devices 112K and 112C for the K and C colors) shown in FIG. 4B are not integrated. Referring to FIG. 4B, the CRUM 201 is included in the photosensitive medium 145KC (which has a longer lifetime than the developing devices 112K and 112C) and manages the lifetimes of the photosensitive medium 145KC and the developing devices 112K and 112C.

Referring to FIGS. 4A and 4B, an image forming apparatus using a two-pass method includes two photosensitive media 145KC and 145YM and corresponding transfer rollers 157KC and 157YM and optical scanners 151KC and 151YM. The photosensitive medium 145KC faces the two developing devices 112K and 112C and the photosensitive medium 145YM faces the two developing devices 112M and 112Y. The developing devices 112K, 112C, 112M, and 112Y are cartridge types which can be replaced individually. As described above with reference to FIG. 2, the replacement time of the photosensitive media 145KC and 145YM can be determined by using the number of replacements of the respective developing devices 112K, 112C, 112M, and 112Y. For example, when each of the photosensitive media 145KC and 145YM has a lifetime of 12,000 pages at 5% density and full toner corresponds to 2,000 pages, the controller 250 may determine that the lifetime of the photosensitive medium 145KC has expired when the sum of the number of replacements of the developing devices 112K and 112C reaches six.

Figure 5:
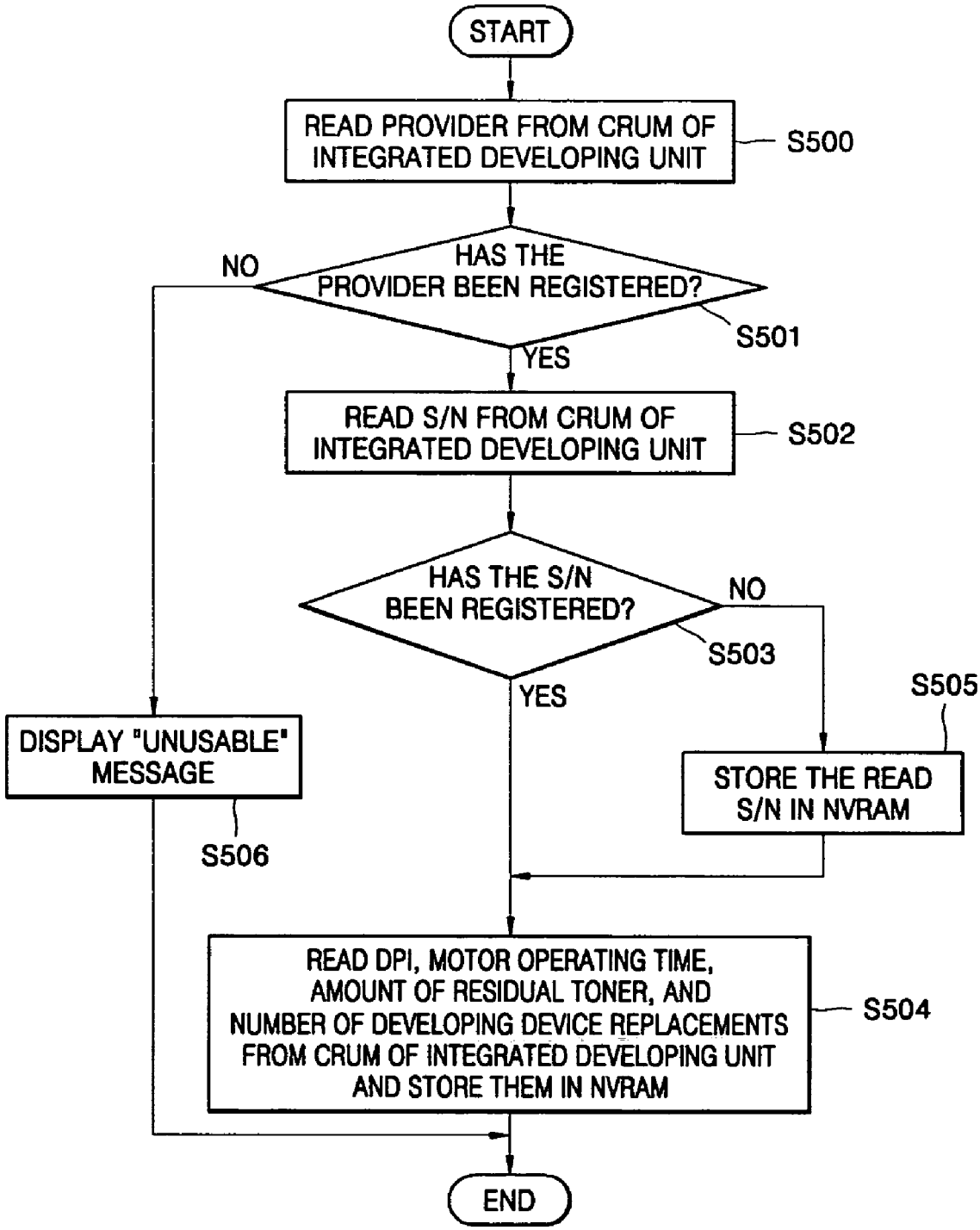
FIG. 5 is a flowchart of a procedure for identifying an integrated developing unit when an image forming apparatus is booted or initially loaded with the integrated developing unit, according to an embodiment of the present invention.

FIG. 5 is a flowchart of a procedure for identifying an integrated developing unit when an image forming apparatus is booted or initially loaded with the integrated developing unit, according to an embodiment of the present invention. Referring to FIG. 5, when the image forming apparatus is booted or initially loaded with an integrated developing unit, in operation S500, the controller 250 reads the identity of the provider from the CRUM 201 of the integrated developing unit 200. In operation S501, the provider read from the CRUM is compared with providers stored in the NVRAM 251. If the provider read from the CRUM is one of the providers stored in the NVRAM 251, in operation S502, the controller 250 reads a unique S/N from the CRUM 201 of the integrated developing unit 200. However, if the provider is not one of the providers stored in the NVRAM 251, in operation S506, the controller 250 displays an "unusable" message through, for example, a display apparatus (not shown).

In operation S503, the read S/N is compared with S/Ns stored in the NVRAM 251. If the read S/N is one of the S/Ns stored in the NVRAM, in operation S504, the controller 250 reads the dpi, the motor operating time, the amount of residual toner, and the number of developing device replacements from the CRUM 201 of the integrated developing unit 200 and stores them in the NVRAM 251. However, if the read S/N is not one of the S/Ns stored in the NVRAM (that is, when the integrated developing unit 200 is a new product or has been used in another image forming apparatus), in operation S505, the controller 250 stores the read S/N in the NVRAM 251 and thereafter performs operation S504.

As described above, the dpi and the motor operating time are used to calculate the amount of toner consumed for printing, and the amount of residual toner is used to determine whether to replace a developing device. The number of developing device replacements is used to determine whether to replace a photosensitive medium, which has a different lifetime than the developing device.

The procedure illustrated in FIG. 5 may be modified appropriately as needed. For example, the process could be performed when a cover of the image forming apparatus is opened and then closed. In the exemplary embodiment illustrated in FIG. 5, the provider is read and compared. Alternatively, a model name of the image forming apparatus may be used to identify an integrated developing unit loaded into the image forming apparatus.

Figure 6:
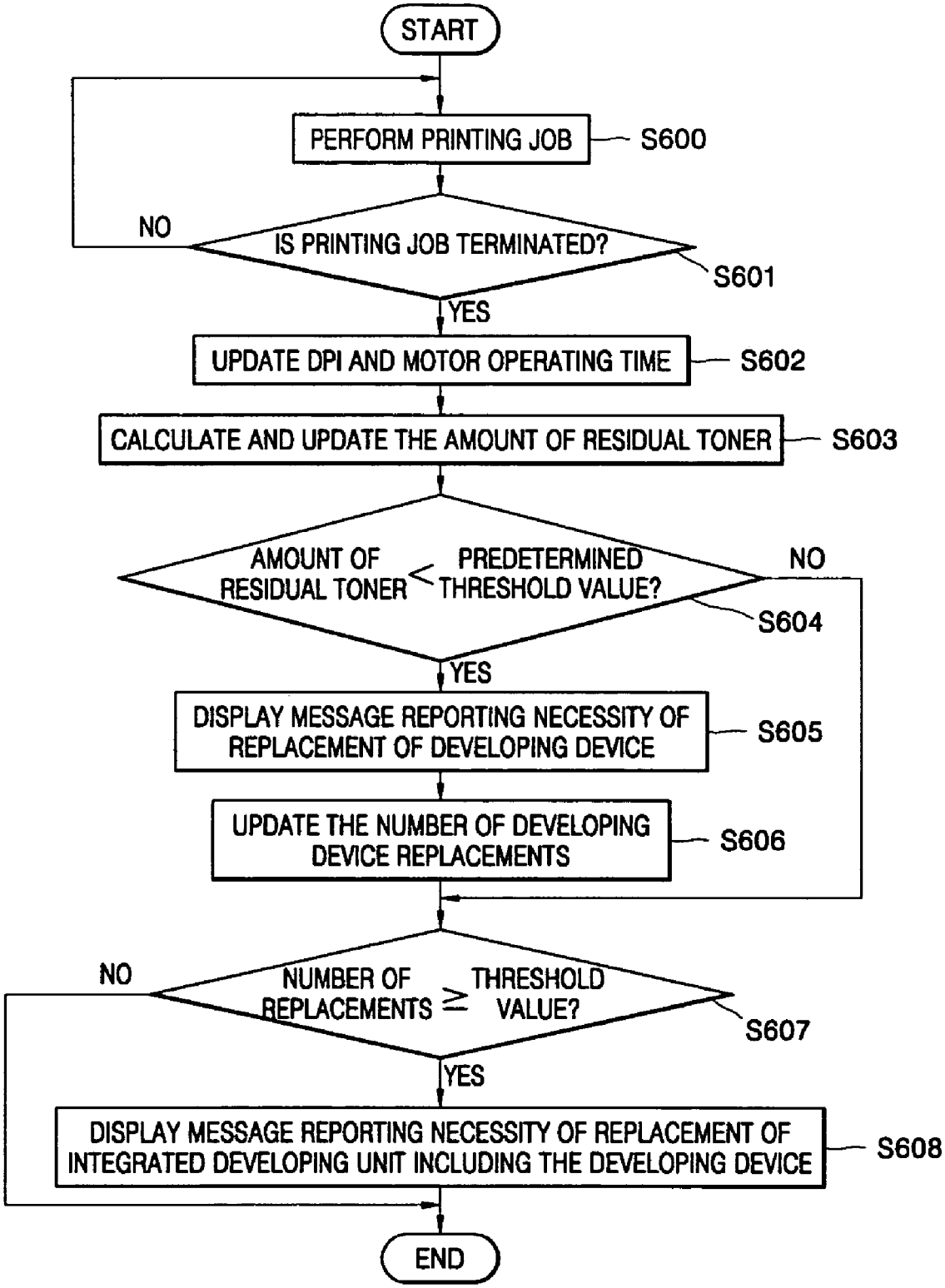
FIG. 6 is a flowchart of a procedure for managing the lifetimes of replaceable elements of an integrated developing unit according to an embodiment of the present invention.

FIG. 6 is a flowchart of a procedure for managing the lifetime of replaceable components (such as the photosensitive medium and the developing unit) of an integrated developing unit according to an embodiment of the present invention. After the procedure illustrated in FIG. 5, in operation S600, the image forming apparatus performs a printing job in response to a user's request. When the printing job is terminated in operation S601, the controller 250 updates the NVRAM 251 and the CRUMs 201 and 211 of the respective integrated developing units 200 and 210 based on the motor operating time and the dpi used during the printing job in operation S602.

In operation S603, the controller 250 calculates the amount of toner remaining in each developing device, which is a cartridge type, using the motor operating time and the dpi used for the printing job and updates the NVRAM 251 and the CRUMs 201 and 211 of the respective integrated developing units 200 and 210.

If the amount of residual toner updated in either of the CRUMs 201 and 211 is less than a predetermined threshold value stored in the NVRAM 251 in operation S604, the controller 250 displays a message reporting that toner in a certain developing device is exhausted to the user in operation S605 so that the user replaces the exhausted developing device. When the exhausted developing device is replaced with a new one, in operation S606, the number of developing device replacements is updated in the NVRAM 251 and the CRUMs 201 and 211 of the respective integrated developing units 200 and 210.

The expiration of the lifetime of a photosensitive medium and a developing unit is determined in operation S607. As described above, the lifetimes of a photosensitive medium and a developing unit may vary according to the configuration of the photosensitive media and the developing units. In a single-pass method, for example, when the lifetime of a photosensitive medium is 12,000 pages at 5% density and full toner corresponds to 2,000 pages, if a developing device for a C color has been replaced 6 times, the apparatus determines that the corresponding photosensitive medium has expired. In a two-pass method, under the same conditions as described in the case of single-pass method, if two developing devices corresponding to one photosensitive medium have been replaced three times, respectively, or if the sum of replacements of the individual two developing devices is six, the apparatus determines that the corresponding photosensitive medium has expired.

When the number of developing device replacements is equal to or greater than a predetermined threshold value stored in the NVRAM 251 in operation S607, a message reporting that the integrated developing unit, including the developing device, must be replaced is displayed in operation S608.

As described above, a plurality of developing units and photosensitive media are managed using a single data storage, thereby decreasing manufacturing cost. In addition, since a plurality of replaceable elements are managed using a single storage, the probability of malfunction decreases. As a result, the reliability and data processing speed of the image forming apparatus increase.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus comprising:

a plurality of photosensitive units, each of the photosensitive units comprising a photosensitive medium;

a plurality of developing devices, each of the developing devices comprising a developing roller and developer, the developing roller applying the developer to a corresponding photosensitive medium;

a plurality of developing units each comprising one of the photosensitive units and one of the developing devices, wherein the developing device is removable from the developing unit;

an integrated developing unit comprising a storage and at least two of the developing units, the integrated developing unit being individually replaceable;

wherein the storage stores information regarding at least one of the photosensitive unit and the developing device of the integrated developing unit;

a controller controlling the information stored in the storage; and a plurality of integrated developing units;

wherein the controller reads and updates redefined information in the storage when a printing job is terminated, calculates and updates the amount of developer remaining in the developing device, counts the number of developing device replacements, and reports the necessity of replacing an integrated developing unit when the counted number of replacements reaches a predetermined threshold value.

2. The image forming apparatus as claimed in claim 1, further comprising:

a plurality of integrated developing units which are individually replaceable, each of the integrated developing units comprising at least two of the developing units.

3. The image forming apparatus as claimed in claim 2, wherein each of the integrated developing units comprises a storage of its own.

4. The image forming apparatus as claimed in claim 1, wherein each of the integrated developing units comprises a storage of its own.

5. The image forming apparatus as claimed in claim 1, wherein the controller identifies one of the integrated developing units when the image forming apparatus is booted or when the integrated developing unit is loaded into the image forming apparatus.

6. The image forming apparatus as claimed in claim 1, wherein the storage is located in the photosensitive unit.

7. The image forming apparatus as claimed in claim 1, wherein the information stored in the storage relates to the lifetime of at least one of the photosensitive unit and the developing device.

8. An image forming apparatus comprising:

a photosensitive unit comprising a photosensitive medium a plurality of developing units, each developing unit comprising a developing roller that applies developer to the photosensitive medium and a developing device that is removable from the developing unit and contains developer supplied to the developing roller;

an integrated developing unit which is replaceable individually, the integrated developing unit comprising at least two of the plurality of developing units;

a storage that is included in one of the photosensitive unit or the developing unit, whichever has a longer lifetime, the storage storing information regarding at least one of the photosensitive unit and the developing unit; and a controller controlling the information stored in the storage;

wherein the image forming apparatus comprises a plurality of the integrated developing units, each of the integrated developing units comprising a plurality of units that integrate the photosensitive unit and the developing unit corresponding to the photosensitive unit; and wherein the controller reads and updates predefined information in the storage when a printing job is terminated, calculates and updates the amount of developer remaining in the developing device, counts the number of developing device replacements, and reports the necessity of replacing an integrated developing unit when the counted number of replacements reaches a predetermined threshold value.

* * * * *